US012121824B1

(12) United States Patent
Sullivan

(10) Patent No.: US 12,121,824 B1
(45) Date of Patent: Oct. 22, 2024

(54) AMUSEMENT DEVICE WITH COOPERATIVE GAMEPLAY

(71) Applicant: STERN PINBALL, INC., Elk Grove Village, IL (US)

(72) Inventor: Dwight Sullivan, Elk Grove Village, IL (US)

(73) Assignee: Stern Pinball, Inc., Elk Grove Village, IL (US)

( * ) Notice: Subject to any disclaimer, the term of this patent is extended or adjusted under 35 U.S.C. 154(b) by 667 days.

(21) Appl. No.: 17/361,311

(22) Filed: Jun. 28, 2021

Related U.S. Application Data

(60) Provisional application No. 63/044,795, filed on Jun. 26, 2020.

(51) Int. Cl.
*A63F 7/02* (2006.01)
*A63F 7/30* (2006.01)
*A63F 9/24* (2006.01)

(52) U.S. Cl.
CPC ..... *A63F 7/027* (2013.01); *A63F 7/30* (2013.01); *A63F 9/24* (2013.01); *A63F 2009/2457* (2013.01)

(58) Field of Classification Search
CPC .. A63F 7/025; A63F 7/027; A63F 7/30; A63F 9/24; A63F 2009/2457
See application file for complete search history.

(56) References Cited

U.S. PATENT DOCUMENTS

| | | | | |
|---|---|---|---|---|
| 4,986,543 | A * | 1/1991 | Heller | A63F 7/027 273/121 A |
| 5,238,248 | A * | 8/1993 | Gottlieb | A63F 7/3075 273/121 A |
| 5,338,031 | A | 8/1994 | Patla, Sr. et al. | |
| 5,890,715 | A * | 4/1999 | Gomez | A63F 7/027 273/121 A |
| 6,158,737 | A | 12/2000 | Cornell et al. | |
| 6,475,083 | B1 | 11/2002 | Gomez et al. | |
| 11,458,384 | B1 * | 10/2022 | Guidarelli | A63F 7/027 |
| 2007/0026918 | A1 | 2/2007 | Sheats, Jr. | |
| 2008/0009331 | A1 | 1/2008 | Moffett | |
| 2008/0143047 | A1 * | 6/2008 | Lokos | A63F 7/0017 273/121 R |
| 2011/0115155 | A1 | 5/2011 | Frontiero, Jr. | |
| 2013/0113161 | A1 | 5/2013 | Guarnieri | |
| 2013/0147111 | A1 | 6/2013 | Popadiuk | |

(Continued)

OTHER PUBLICATIONS

Office Action from U.S. Appl. No. 17/364,249, dated Mar. 28, 2024, 8 pp.

*Primary Examiner* — Raleigh W Chiu
(74) *Attorney, Agent, or Firm* — Greenberg Traurig, LLP

(57) ABSTRACT

An apparatus for controlling an amusement device includes a plurality of targets of a playfield of the amusement device, a memory, and a processor. The processor is configured to receive an indication that a first target of the plurality of targets is hit during a first player turn. The processor is further configured to send, based on the indication, a signal to a moveable component of the playfield to unlock access to a second target of the plurality of targets during the first player turn. The processor is further configured to determine that the first player turn has ended. The processor is further configured to keep the second target unlocked during a second player turn.

14 Claims, 6 Drawing Sheets

(56) References Cited

U.S. PATENT DOCUMENTS

| | | | | |
|---|---|---|---|---|
| 2013/0181399 | A1 | 7/2013 | Stellenberg | |
| 2013/0228970 | A1 | 9/2013 | Stellenberg | |
| 2015/0001796 | A1* | 1/2015 | Stellenberg ..... | A63F 7/26 273/121 A |
| 2015/0091250 | A1 | 4/2015 | Popadiuk, Jr. | |
| 2017/0001100 | A1 | 1/2017 | Stellenberg | |

* cited by examiner

AMUSEMENT DEVICE WITH COOPERATIVE GAMEPLAY

CROSS-REFERENCE TO RELATED APPLICATION

This application claims the benefit of U.S. Provisional Patent Application No. 63/044,795, filed Jun. 26, 2020, the entire contents of which is hereby incorporated by reference in its entirety.

FIELD OF THE DISCLOSURE

The present disclosure relates generally to amusement devices and more particularly to an amusement device with cooperative gameplay.

BACKGROUND OF RELATED ART

Amusement game devices, such as pinball machines, redemption games, etc. of the commercial, e.g., revenue generating, and non-commercial, e.g., home entertainment, type are well known in the art. By way of example, U.S. Pat. Nos. 5,338,031, 6,158,737, and U.S. Published Application No. 2007/0026918 illustrate and describe amusement game devices of the type having a cabinet which houses a playfield.

Pinball machines typically have a simple game format that includes a single player attempting to keep a pinball active on the playfield for as long as possible, while scoring points for activating and interacting with various game features. While many pinball machines allow multiple players to have active games on a pinball machine at the same time, each player's game is traditionally serial played (turn-based play), with each player interacting with their own gameplay. For instance, in most pinball machines, if four active games are allowed at a time, the first player typically plays until their first ball drains and their turn is over, wherein the second player proceeds to play their first ball with all game features being separate from any influence by the first player. This turn-based play oftentimes proceeds until all players have their allotted number of balls played. Upon completion of all game plays, each player is provided an individual score based solely upon their game play.

While the traditional turn-based game format generally works for its intended purpose, there is an identifiable need for improvements to gameplay features.

SUMMARY

The following describes systems, methods, and computer readable media for pre-cooperative gameplay of an amusement game device. For example, an apparatus for controlling an amusement device includes a plurality of targets of a playfield of the amusement device, a memory, and a processor. The processor is configured to receive an indication that a first target of the plurality of targets is hit during a first player turn. The processor is further configured to send, based on the indication, a signal to a moveable component of the playfield to unlock access to a second target of the plurality of targets during the first player turn. The processor is further configured to determine that the first player turn has ended. The processor is further configured to keep the second target unlocked during a second player turn.

While the forgoing provides a general explanation of the subject invention, a better understanding of the objects, advantages, features, properties and relationships of the subject invention will be obtained from the following detailed description and accompanying drawings which set forth illustrative embodiments and which are indicative of the various ways in which the principles of the subject invention may be employed.

BRIEF DESCRIPTION OF THE DRAWINGS

For a better understanding of the subject invention, reference may be had to embodiments shown in the attached drawings in which.

DETAILED DESCRIPTION

The following description of example methods and apparatus is not intended to limit the scope of the description to the precise form or forms detailed herein. Instead the following description is intended to be illustrative so that others may follow its teachings.

An example pinball machine disclosed herein provides for an alternative to traditional turn-based gameplay. While the methods disclosed herein are directed towards a traditional four-player pinball machine arrangement, it will be understood that any suitable number of players may utilize the teaching herein.

Figure 1:
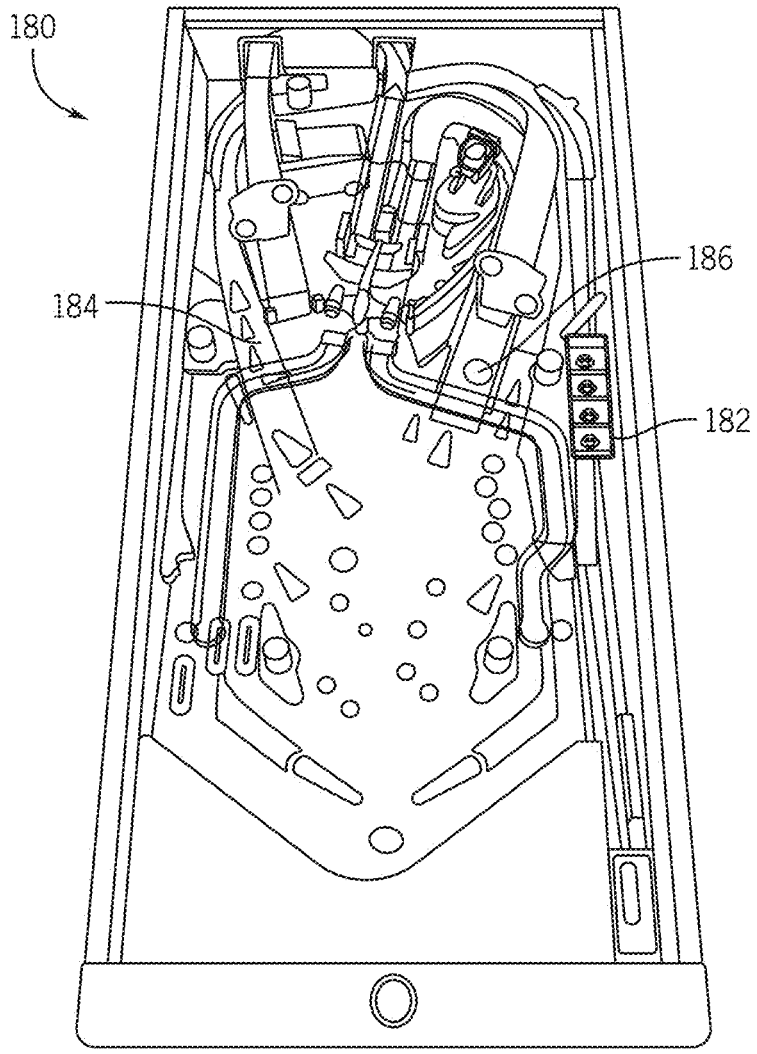
FIG. 1 illustrates a top perspective view of an example playfield of an amusement game according to the various embodiments disclosed herein.

An example pinball playfield 180 is shown in FIG. 1. In particular, FIG. 1 illustrates a top perspective view of the playfield 180 of an amusement game. In this example, the pinball playfield 180 includes a plurality of targets (e.g., features) that when contacted with a ball, cause various game elements to score points and trigger additional game features and/or goals. For example, targets 184 and 186 may be ramps that have sensors in them so that when a ball travels on the ramp, the game can sense that the target 184 or 186 has been achieved by the player.

In an example gameplay, distinct "characters" may be selectable by a player prior to or during gameplay. In the example of FIG. 1, character indicator 182 shows four different selectable characters, though it will be appreciated that other numbers of characters may be selectable as desired.

Figure 2:
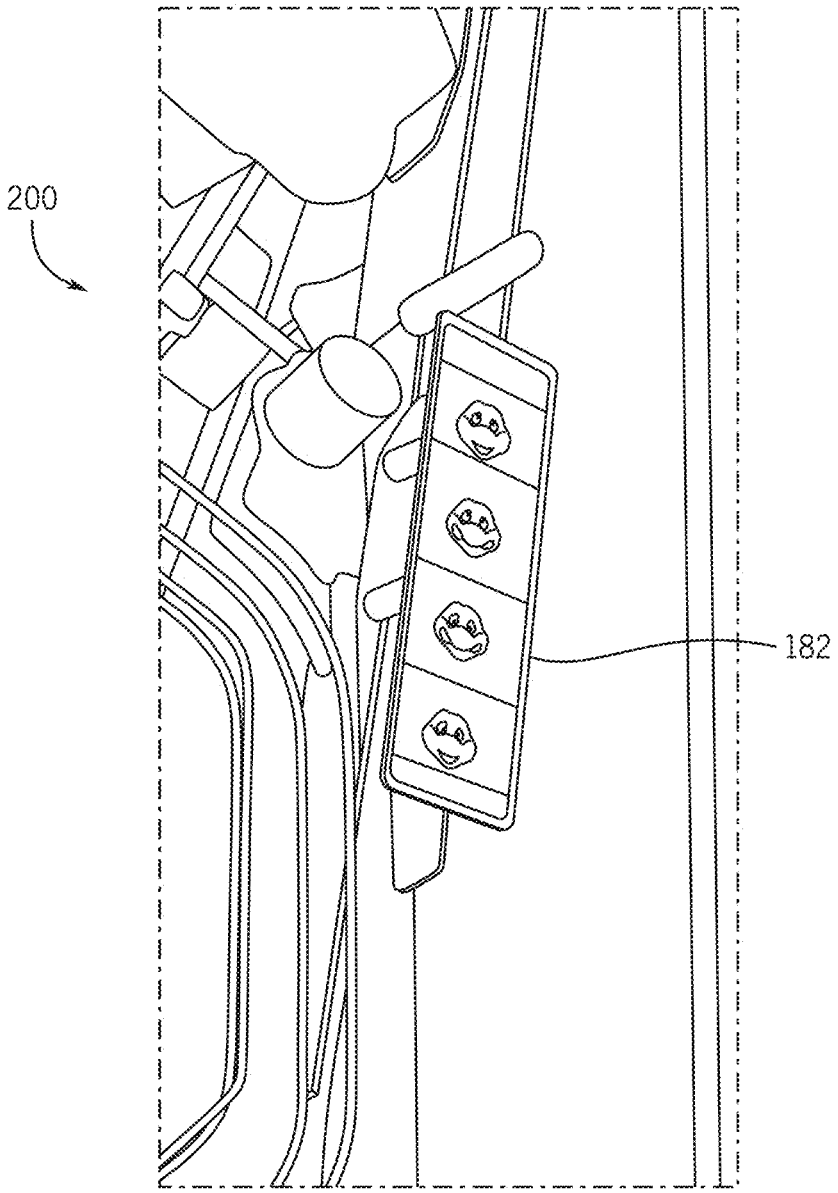
FIG. 2 illustrates a character indicator of the example playfield of FIG. 1 according to the various embodiments disclosed herein.

FIG. 2 illustrates the character indicator 182 of the example playfield 180 of FIG. 1 in greater detail. In various embodiments, each "character" may having its own set of unique goals and targets to advance gameplay and/or features. The character indicator 182 may include lights that illuminate what character is assigned to each player during their turn, and/or may be illuminated to indicate a selected character when a player is choosing what character they will be (e.g., before the game starts, before a given player's first turn starts, during a character selection phase of a given player's turn, etc.). In various embodiments, the character indicator 182 may additionally include an indication of a players perk or other characteristic of the character. Player perks are further discussed below with respect to FIG. 4.

Figure 3:
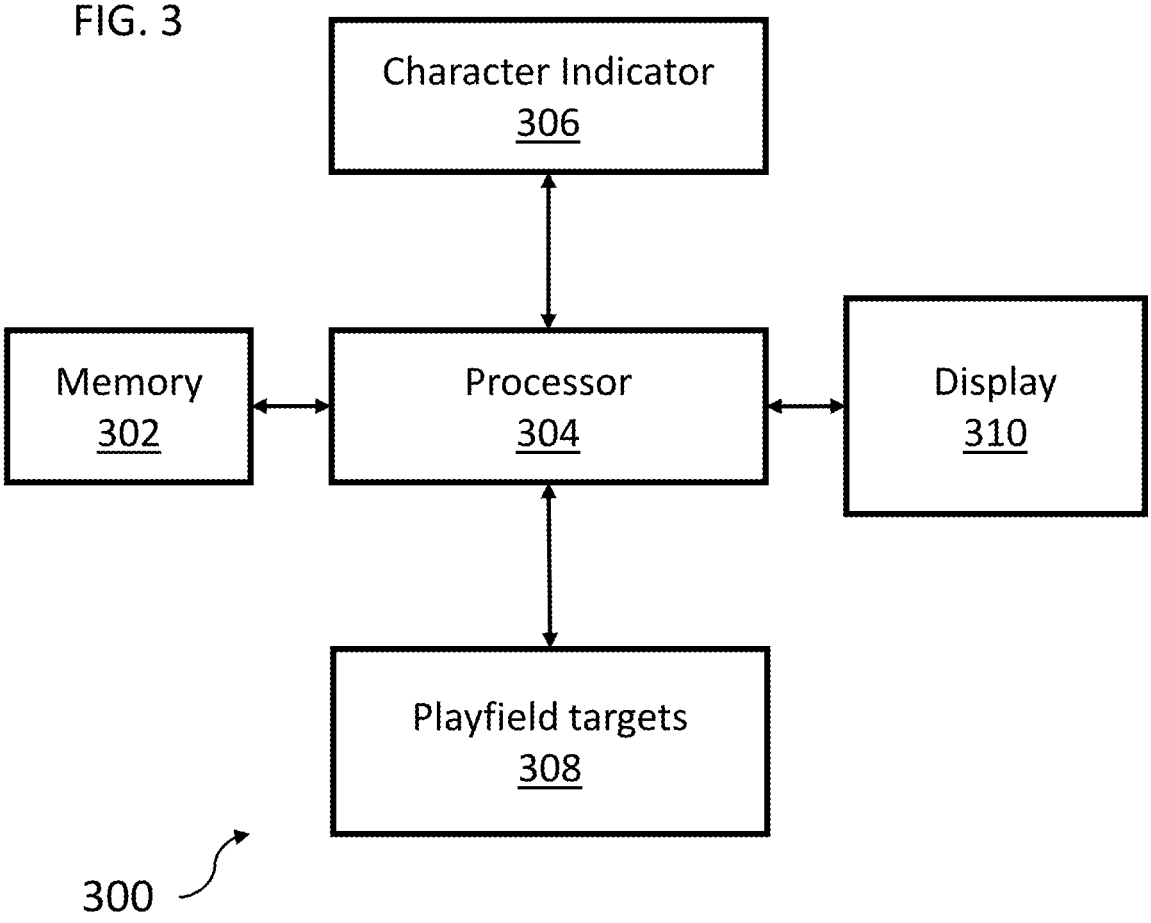
FIG. 3 illustrates a block diagram view of an example system for implementing cooperative gameplay according the various embodiments disclosed herein.

FIG. 3 illustrates a block diagram view of an example system 300 for implementing cooperative gameplay. The various components of the example system 300 of FIG. 3 may be part of an amusement device. The amusement device may be a pinbal table, and may include a playfield such as the playfield 180 of FIG. 1. The system 300 may include a memory 302 and a processor 304 operably coupled to the memory. The memory 302 may be one or more types of memory, and may store different data and/or computer readable media, which when executed by the processor may execute different methods for cooperative gameplay disclosed herein, including controlling playfield targets 308, character indicators 306, and/or one or more displays 310. In some embodiments, the methods described herein may also be executed by a computing device as shown in and described below with respect to FIG. 6, or may be executed using one or more components shown in and described below with respect to FIG. 6.

For example, the playfield targets 308 may be controlled according to various embodiments, such as activating them for different players based on perks (e.g., as discussed below with respect to FIG. 4), and/or unlocking them for one or more players based on goals achieved (e.g., as discussed below with respect to FIG. 5). The playfield targets 308 may also be interacted with to score points, which may be totaled for multiple players who are playing together cooperatively as a team. The playfield targets 308 may be, for example the targets 184 and 186 of FIG. 1.

The character indicator 306 may be, for example, the character indicator 182 of FIG. 1. The processor 304 may be configured to receive user inputs, e.g., from buttons associated with flippers of a pinball machine, to control selection of a character by a given player, which may be indicated by the character indicator 306. Further, as described herein, the character indicator 306 may be controlled by the processor 304 to indicate which selected character's turn it current is during cooperative gameplay.

The display 310 may be controlled by the processor 304 to display a team's combined score, display information about a team's collective goals or features or targets unlocked, etc. The display 310 may also be controlled by the processor to explain perks of a player that are active during gameplay or that may be applicable to a given character during character selection.

In an example embodiment, at the beginning of a game, each player may select one of the possible provided characters (in this example one of four characters). Each character may have its own perk or set of perks, goal or set of goals, and/or one or more features awarded by reaching one or more target milestones within the game. In one example, each character receives a specialized "perk" (i.e., game play and/or game advantage) at the start of the game, and may proceed through the game with different perks associated with that character. The perks may be unique to the chosen character, or shared between various characters. The perk may be a scoring bonus for hitting certain types of targets or achieving certain goals. Sometimes, goals may require hitting certain targets in a particular sequence, so a perk may reduce the number of targets needed to reach such a goal, may eliminate a necessary sequence order required to achieve the goal, or any other advantage for reaching a multi-target goal. In various embodiments, an amusement game may also have certain targets that are not accessible to a ball in a playfield until one or more certain goals are reached or other targets are hit. In such embodiments, a perk of a character may include having a physical feature that blocks such a target or otherwise makes it normally inaccessible may be moved automatically at the start of the player's turn without requiring them to complete the intermediate goal or hitting the intermediate target. Such a perk may give the player an advantage in achieving a goal.

Figure 4:
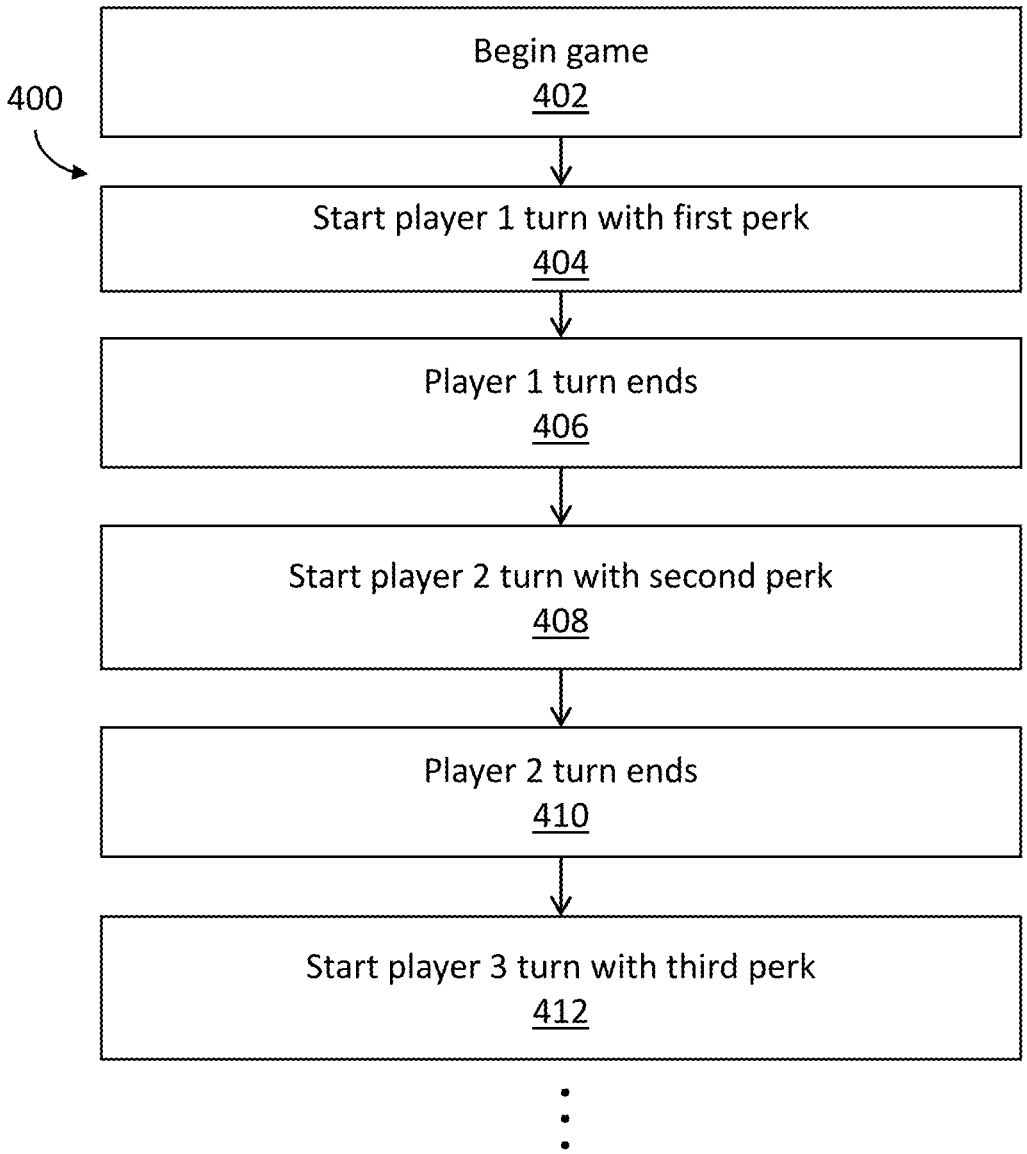
FIG. 4 is a flow diagram illustrating a method for starting multiple players with a different perk during cooperative gameplay of an amusement device according to the various embodiments disclosed herein.

FIG. 4 is a flow diagram illustrating a method 400 for starting multiple players with a different perk during cooperative gameplay of an amusement device. At an operation 402, a multiplayer game with cooperative gameplay is begun. Player 1's turn is started with a first perk activated at an operation 404. At an operation 406, player 1's turn ends and player 2's turn is subsequently started with a second perk associated with player 2's character activated at an operation 408. At an operation 410, player 2's turn ends, and player 3's turn is started with a third perk activated at an operation 412. This process may be iterated for more players as desired. In this way, cooperative gameplay may give certain players different advantages based on different perks in a way that does disadvantage competitors because the players are all competing with one another as opposed to against one another.

It will be understood that in one example, the presently disclosed pinball machine may operate in a traditional turn-based scenario, with each player being able to choose any "character" (i.e., "characters" may be duplicated) or alternatively, being able to choose any unique character, such that each character being played sequentially is unique. In various embodiments, each player may be required to choose or may be assigned different characters, while in other embodiments players may optionally choose the same the character, as some players may desire a perk of a particular character.

During the cooperative mode of play (Co-op), the game is played with each player cooperating with one another to achieve some goal. In other words, the players are on the same team and they will work together to beat the game. In this mode, all the scores a player earns will be awarded to all players. And some progress a player earns against various goals in the game will be spotted for all the other players.

The players may choose to fully cooperate, or alternatively can choose various variations of cooperative play. For example, the player can choose that one or more players are designated as being on an opposite "team" and thus the players are competing against the other teams. (e.g., one player versus three players (1v3), or two players versus two players (2v2)). It will be appreciated that there may be additional teams in some instances (e.g., 1v1v2).

In the example gameplay disclosed, when a player makes a particular shot or completes a goal (either relevant to their chosen character, or relevant to game play in general) they may not only enable something in their game they also enable something in the game of the other players.

For example, in a four-player game, the first player may something in their game to accomplish some goal, made a particular shot, complete a game feature, etc., that the game rules set upon you. Accomplishing the goal typically provides some advantage to the player achieving the goal. For example, achieving the goal may have advanced player one's game in some quantifiable way. Because the four-players are proceeding in a cooperative gameplay, the goal that was completed by the first player also advances or enables the same feature, or a different feature for one or more other members of the team the next time they play their ball. Such a method is described further with respect to FIG. 5.

Specifically, in the example pinball machine disclosed, when a player makes the skill shot associated with their character, a specialized target, in this instance a "weapon" target (or feature) is activated. If the player is participating in a cooperative game, not only will the player activate the "weapon" target or feature for the player making the initial shot, but the same "weapon" target or feature will be activated for all the remaining players that ball.

In some examples, player one will only every get a maximum of one feature per ball, whereas player two can get up to two (theirs plus player one's), player three up to three, and so on. It will be appreciated that the cooperative features may reset after the last player plays their sequential ball, or the features may continue to be cooperatively passed between players during the entire duration of the gameplay (i.e., through all available balls).

Figure 5:
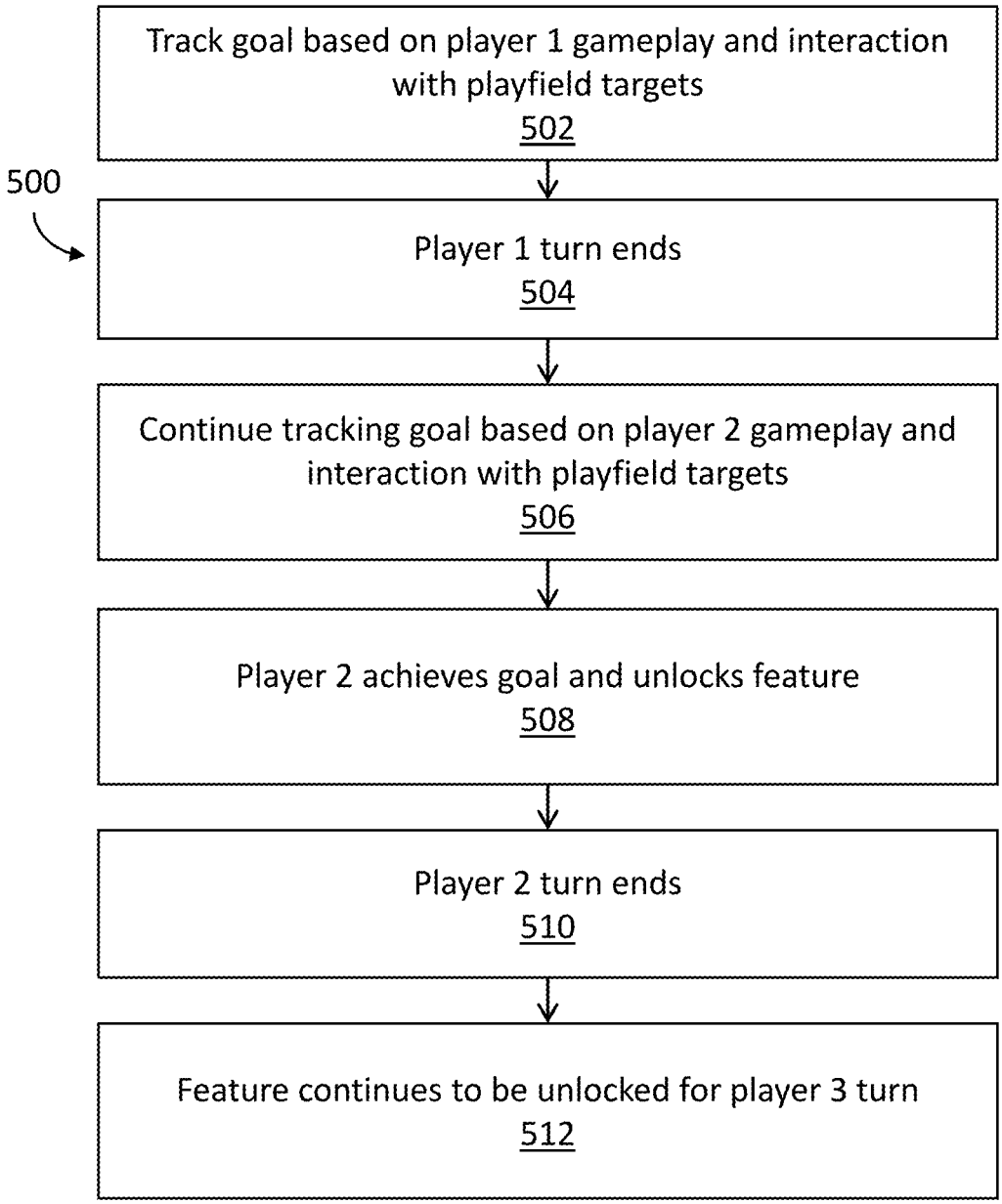
FIG. 5 is a flow diagram illustrating a method for unlocking goals during cooperative gameplay of an amusement device according to the various embodiments disclosed herein.

FIG. 5 is a flow diagram illustrating a method 500 for unlocking goals during cooperative gameplay of an amusement device according to the various embodiments disclosed herein. At an operation 502, a goal (e.g., sequence of desired targets to hit) may be tracked based on player 1's gameplay during their turn (e.g., as they hit playfield targets). At an operation 504, player 1's turn ends. At an operation 506, the same goal player 1 was working on may continue to be tracked during player 2's turn. In this way, if a goal requires 4 steps to complete, player 1 may complete 2 and player 2 may complete 2. In this way, at an operation 508, player 2 may achieve a goal and unlock a feature as described herein (e.g., a feature that was previously blocked or inaccessible in the playfield). Accordingly, players across multiple turns may cooperate to achieve a goal. At an operation 510, player 2's turn may end, and the unlocked feature may continue to be unlocked for player 3's turn at an operation 512. In this way, as described herein, players may cooperate to unlock one or more features for one another, benefitting the turns of other players.

The pinball machine, and more particularly the example playfield, may use specialized lighting to indicate to the player(s) that various targets/features are activated because of a previous player's actions. For instance, in one example, a colored light (e.g., a RGB light) is utilized to indicate how many features have been passes to a particular player. In one example, if the indicator is blinking Red and Blue it means that the current player and one other member of the current player's team have made their skill shots and lit weapon for you.

As disclosed, in one example game, at the beginning of the game, each player selects one of the four characters, which in this instance are identified a "turtles." Each character has their own set of perks awarded by completing various goals set up by the game rules. Each character begins play at a minimum level ("level 1") and therefore receives that perk at the start of the game.

Character One: Level 1: Light Turtle Power; Level 2: 2× Foot Combo Scores; Level 3: Add Time to All Ball Saves; and Level 4: 3× Turtle Power Scores. Character Two: Level 1: Light Battle Again; Level 2: 2× April Hurry-Up Scores; Level 3: 2× Pizza Eating Contest; and Level 4: 3× Ninja Pizza Multiball Scores. Character Three: Level 1: Episodes Lit; Level 2: 2× Krang Kombo Scores; Level 3: Increase Playfield Multiplier; and Level 4: 3× Episode Scores. Character Four: Level 1: Light Training; Level 2: Add 10 Seconds to All Timers; Level 3: 2× Weapon Hurry-Up Scores; and Level 4: 2× Team Up Multiball Scores.

Weapon Skill Shot: When a player begins game play, typically by plunging the ball into the playfield by a shooter rod, there is a timer to allow the player the opportunity to shoot a particle lit shot that corresponds to the player's chosen character. If the player accomplishes the skill shot in the allotted time, the goal is achieved.

Weapon Hurry-ups (WHU): If a player shoots a ball over a sensor in a particular lit "weapon" inlane, the player will begin a "cascading hurry-up." In particular, a simple weapon shot will be lit for a first point amount, and if accomplished, the target value will be locked in another WHU shot worth a new value (typically higher) will be activated. In one example game play, the number of WHU shots may be limited during a single ball play (i.e., limited to two for the first ball). Subsequent WHU will have more total shots available. In other words, during a second ball, if a player has collected the WHU during the first ball play, that player will have three cascading WHU shots available.

As noted above, in the disclosed cooperative mode, the total number of WHU shots increases for ALL teammates.

Although certain example methods, apparatuses, and computer readable media have been described herein, the scope of coverage of this patent is not limited thereto. On the contrary, this patent covers all methods, apparatus, computer readable media, and articles of manufacture fairly falling within the scope of the appended claims either literally or under the doctrine of equivalents.

Figure 6:
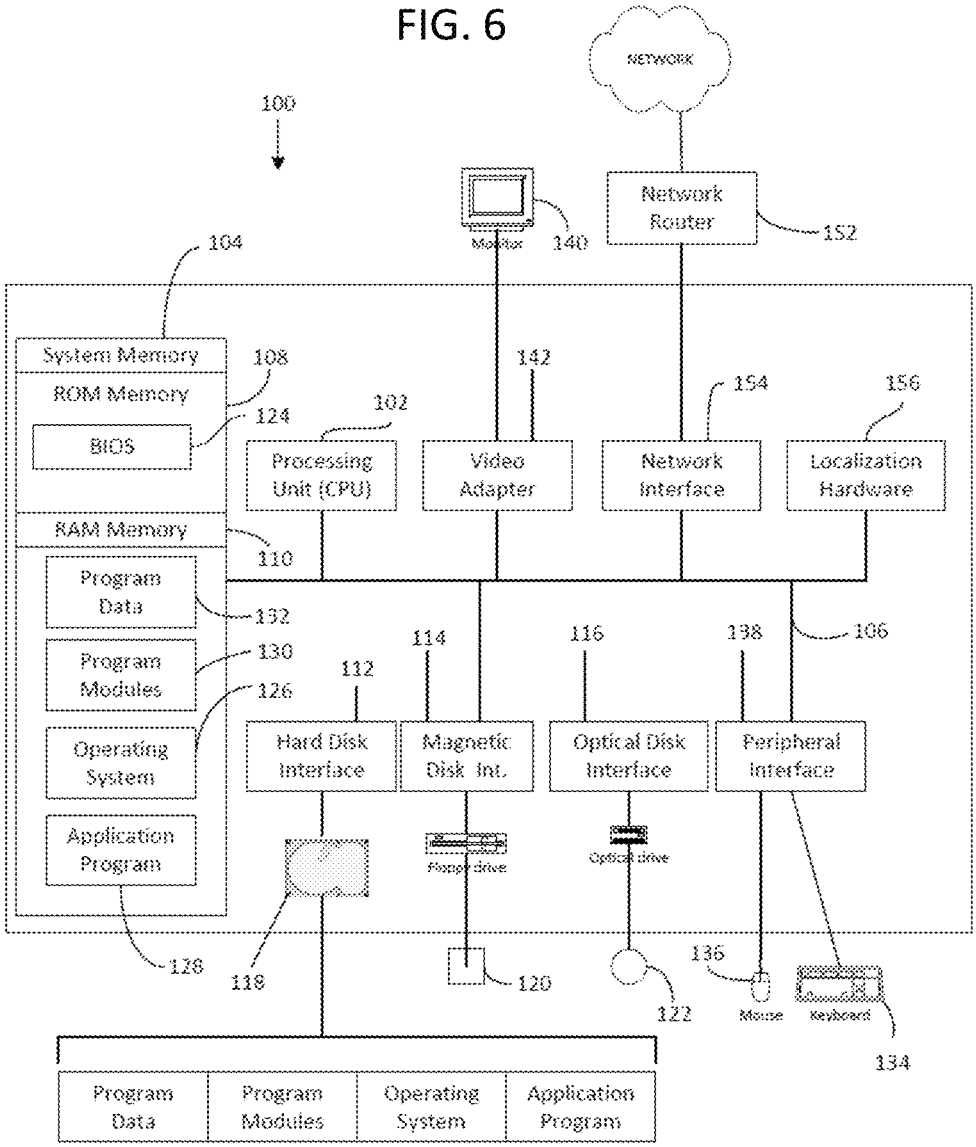
FIG. 6 is a diagrammatic view of an example embodiment of a user computing environment in which the methods described herein may be employed.

FIG. 6 is a diagrammatic view of an example embodiment of a user computing environment that includes a general-purpose computing system environment 100, such as a desktop computer, laptop, smartphone, tablet, or any other such device having the ability to execute instructions, such as those stored within a non-transient, computer-readable medium. Furthermore, while described and illustrated in the context of a single computing system 100, those skilled in the art will also appreciate that the various tasks described hereinafter may be practiced in a distributed environment having multiple computing systems 100 linked via a local or wide-area network in which the executable instructions may be associated with and/or executed by one or more of multiple computing systems 100.

In its most basic configuration, computing system environment 100 typically includes at least one processing unit 102 and at least one memory 104, which may be linked via a bus 106. Depending on the exact configuration and type of computing system environment, memory 104 may be volatile (such as RAM 110), non-volatile (such as ROM 108, flash memory, etc.) or some combination of the two. Computing system environment 100 may have additional features and/or functionality. For example, computing system environment 100 may also include additional storage (removable and/or non-removable) including, but not limited to, magnetic or optical disks, tape drives and/or flash drives. Such additional memory devices may be made accessible to the computing system environment 100 by means of, for example, a hard disk drive interface 112, a magnetic disk drive interface 114, and/or an optical disk drive interface 116. As will be understood, these devices, which would be linked to the system bus 306, respectively, allow for reading from and writing to a hard disk 118, reading from or writing to a removable magnetic disk 120, and/or for reading from or writing to a removable optical disk 122, such as a CD/DVD ROM or other optical media. The drive interfaces and their associated computer-readable media allow for the nonvolatile storage of computer readable instructions, data structures, program modules and other data for the computing system environment 100. Those skilled in the art will further appreciate that other types of computer readable media that can store data may be used for this same purpose. Examples of such media devices include, but are not limited to, magnetic cassettes, flash memory cards, digital videodisks, Bernoulli cartridges, random access memories, nanodrives, memory sticks, other read/write and/or read-only memories and/or any other method or technology for storage of information such as computer readable instructions, data structures, program modules or other data. Any such computer storage media may be part of computing system environment 100.

A number of program modules may be stored in one or more of the memory/media devices. For example, a basic input/output system (BIOS) 124, containing the basic routines that help to transfer information between elements within the computing system environment 100, such as during start-up, may be stored in ROM 108. Similarly, RAM 110, hard drive 118, and/or peripheral memory devices may be used to store computer executable instructions comprising an operating system 126, one or more applications programs 128 (which may include the functionality disclosed herein, for example), other program modules 130, and/or program data 122. Still further, computer-executable instructions may be downloaded to the computing environment 100 as needed, for example, via a network connection.

An end-user may enter commands and information into the computing system environment 100 through input devices such as a keyboard 134 and/or a pointing device 136. While not illustrated, other input devices may include a microphone, a joystick, a game pad, a scanner, etc. These and other input devices would typically be connected to the processing unit 102 by means of a peripheral interface 138 which, in turn, would be coupled to bus 106. Input devices may be directly or indirectly connected to processor 102 via interfaces such as, for example, a parallel port, game port, firewire, or a universal serial bus (USB). To view information from the computing system environment 100, a monitor 140 or other type of display device may also be connected to bus 106 via an interface, such as via video adapter 132. In addition to the monitor 140, the computing system environment 100 may also include other peripheral output devices, not shown, such as speakers and printers.

The computing system environment 100 may also utilize logical connections to one or more computing system environments. Communications between the computing system environment 100 and the remote computing system environment may be exchanged via a further processing device, such a network router 152, that is responsible for network routing. Communications with the network router 152 may be performed via a network interface component 154. Thus, within such a networked environment, e.g., the Internet, World Wide Web, LAN, or other like type of wired or wireless network, it will be appreciated that program modules depicted relative to the computing system environment 100, or portions thereof, may be stored in the memory storage device(s) of the computing system environment 100.

The computing system environment 100 may also include localization hardware 186 for determining a location of the computing system environment 100. In embodiments, the localization hardware 156 may include, for example only, a GPS antenna, an RFID chip or reader, a WiFi antenna, or other computing hardware that may be used to capture or transmit signals that may be used to determine the location of the computing system environment 100.

While this disclosure has described certain embodiments, it will be understood that the claims are not intended to be limited to these embodiments except as explicitly recited in the claims. On the contrary, the instant disclosure is intended to cover alternatives, modifications and equivalents, which may be included within the spirit and scope of the disclosure. Furthermore, in the detailed description of the present disclosure, numerous specific details are set forth in order to provide a thorough understanding of the disclosed embodiments. However, it will be obvious to one of ordinary skill in the art that systems and methods consistent with this disclosure may be practiced without these specific details. In other instances, well known methods, procedures, components, and circuits have not been described in detail as not to unnecessarily obscure various aspects of the present disclosure.

Some portions of the detailed descriptions of this disclosure have been presented in terms of procedures, logic blocks, processing, and other symbolic representations of operations on data bits within a computer or digital system memory. These descriptions and representations are the means used by those skilled in the data processing arts to most effectively convey the substance of their work to others skilled in the art. A procedure, logic block, process, etc., is herein, and generally, conceived to be a self-consistent sequence of steps or instructions leading to a desired result. The steps are those requiring physical manipulations of physical quantities. Usually, though not necessarily, these physical manipulations take the form of electrical or magnetic data capable of being stored, transferred, combined, compared, and otherwise manipulated in a computer system or similar electronic computing device. For reasons of convenience, and with reference to common usage, such data is referred to as bits, values, elements, symbols, characters, terms, numbers, or the like, with reference to various presently disclosed embodiments.

It should be borne in mind, however, that these terms are to be interpreted as referencing physical manipulations and quantities and are merely convenient labels that should be interpreted further in view of terms commonly used in the art. Unless specifically stated otherwise, as apparent from the discussion herein, it is understood that throughout discussions of the present embodiment, discussions utilizing terms such as "determining" or "outputting" or "transmitting" or "recording" or "locating" or "storing" or "displaying" or "receiving" or "recognizing" or "utilizing" or "generating" or "providing" or "accessing" or "checking" or "notifying" or "delivering" or the like, refer to the action and processes of a computer system, or similar electronic computing device, that manipulates and transforms data. The data is represented as physical (electronic) quantities within the computer system's registers and memories and is transformed into other data similarly represented as physical quantities within the computer system memories or registers, or other such information storage, transmission, or display devices as described herein or otherwise understood to one of ordinary skill in the art.

We claim:

1. An apparatus for controlling an amusement device comprising:

a plurality of targets of a playfield of the amusement device;

a memory; and a processor configured to:

receive an indication that a first target of the plurality of targets is hit during a first player turn;

send, based on the indication, a signal to a moveable component of the playfield to unlock access to a second target of the plurality of targets during the first player turn;

determine that the first player turn has ended; and keep the second target unlocked during a second player turn.

2. The apparatus of claim 1, wherein the processor is further configured to determine that the second player turn has ended.

3. The apparatus of claim 2, wherein the processor is further configured to keep the second target unlocked during a third player turn.

4. The apparatus of claim 1, wherein the processor is configured to receive a second indication that a third target of the plurality of targets is hit during the second player turn.

5. The apparatus of claim 4, wherein the processor is configured to send, based on the second indication, a second signal to a second moveable component of the playfield to unlock access to a fourth target of the plurality of targets during the second player turn.

6. The apparatus of claim 5, wherein the processor is further configured to determine that the second player turn has ended.

7. The apparatus of claim 6, wherein the processor is further configured to keep the second target and the fourth target unlocked during a third player turn.

8. A method for controlling an amusement device comprising:

receiving, at a processor of a computing device, an indication that a first target of a plurality of targets of a playfield of the amusement device is hit during a first player turn;

sending, by the processor based on the indication, a signal to a moveable component of the playfield to unlock access to a second target of the plurality of targets during the first player turn;

determining, by the processor, that the first player turn has ended; and keeping, by the processor, the second target unlocked during a second player turn.

9. The method of claim 8, further comprising determining, by the processor, that the second player turn has ended.

10. The method of claim 9, further comprising keeping, by the processor, the second target unlocked during a third player turn.

11. The method of claim 8, further comprising receiving, by the processor, a second indication that a third target of the plurality of targets is hit during the second player turn.

12. The method of claim 11, further comprising sending, by the processor based on the second indication, a second signal to a second moveable component of the playfield to unlock access to a fourth target of the plurality of targets during the second player turn.

13. The method of claim 12, further comprising determining, by the processor, that the second player turn has ended.

14. The method of claim 13, further comprising keeping, by the processor the second target and the fourth target unlocked during a third player turn.

* * * * *